US006657599B2

(12) United States Patent
Solbach

(10) Patent No.: US 6,657,599 B2
(45) Date of Patent: Dec. 2, 2003

(54) SLOT ANTENNA

(75) Inventor: Klaus Solbach, Muelheim (DE)

(73) Assignee: EADS Deutschland GmbH, Munich (DE)

( * ) Notice: Subject to any disclaimer, the term of this patent is extended or adjusted under 35 U.S.C. 154(b) by 0 days.

(21) Appl. No.: 10/156,661

(22) Filed: May 29, 2002

(65) Prior Publication Data

US 2002/0190910 A1 Dec. 19, 2002

(30) Foreign Application Priority Data

May 31, 2001 (DE) ..... 101 26 468

(51) Int. Cl.[7] ..... H01Q 21/00
(52) U.S. Cl. ..... 343/767; 343/727
(58) Field of Search ..... 343/767, 727, 343/771, 853, 770, 789

(56) References Cited

U.S. PATENT DOCUMENTS 3,778,838 A * 12/1973 Clavin ..... 343/727
4,429,313 A * 1/1984 Muhs, Jr. et al. ..... 343/771
5,619,216 A * 4/1997 Park ..... 343/771
6,166,610 A * 12/2000 Ramanujam et al. ..... 333/21 A
6,166,699 A * 12/2000 Khammouni et al. ..... 343/756
6,181,222 B1 * 1/2001 Seewig et al. ..... 333/126
6,476,772 B1 * 11/2002 Smith et al. ..... 343/771

* cited by examiner

*Primary Examiner*—James Clinger
(74) *Attorney, Agent, or Firm*—Crowell & Moring LLP

(57) ABSTRACT

A slot antenna has a feeding waveguide extending in a longitudinal direction for guiding electromagnetic waves, with at least one slot constructed in a broad side of the waveguide for emitting an electromagnetic wave. The slot is surrounded on the exterior side of the waveguide by an arrangement for rotating the polarization direction of the electromagnetic wave emitted by the slot. According to the invention, the slot is constructed in the longitudinal direction of the waveguide and the arrangement surrounding the slot is a rectangular polarizer waveguide. One opening of the polarizing waveguide is connected with the broad side of the waveguide and the other has an aperture via which the wave excited by the slot in the polarizer waveguide is emitted. Relative to the slot, the polarizer waveguide is aligned such that its first transverse axis forms an angle with the longitudinal axis of the slot, the angle representing that angle by which the polarization of the electromagnetic wave emitted from the slot into the polarizer waveguide is rotated.

11 Claims, 1 Drawing Sheet

SLOT ANTENNA

BACKGROUND AND SUMMARY OF THE INVENTION

This application claims the priority of German patent document 101 26 468.2, filed May 31, 2001, the disclosure of which is expressly incorporated by reference herein.

In slot antennas, rectangular or ridge waveguides are used to guide an electromagnetic wave for the excitation of a slot in a first (broad side) wall of the waveguide.

Figure 1:
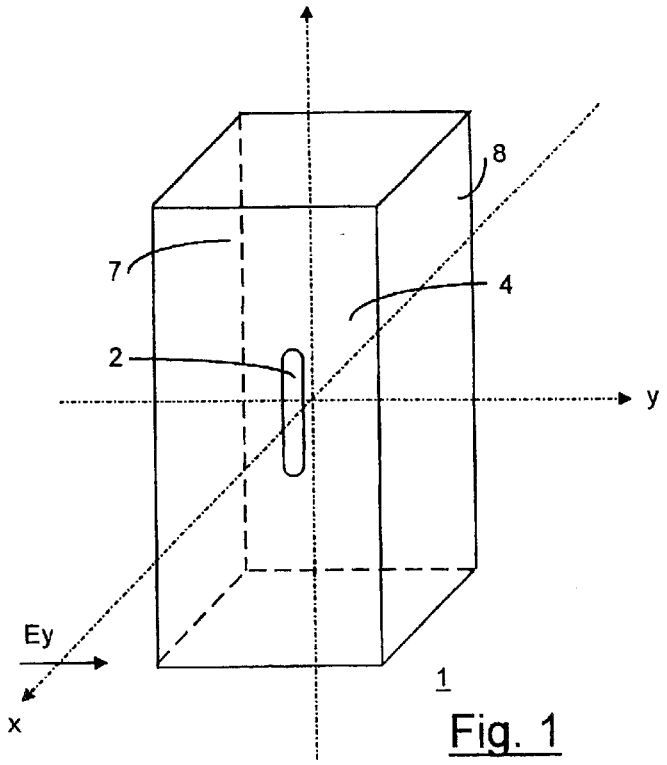

The polarization direction (that is, the direction of the electric field vector in the far field of the emitted wave) is determined by the direction of the slot, as illustrated in FIG. 1. In the main radiation direction of the slot, which has the reference number 2, the electric far field is situated perpendicular to the slot plane, specifically as an $E_y$-component. The waveguide, which has the reference number 1, is constructed as a rectangular waveguide. To rotate the polarization according to the prior art, either the slot 2 must be rotated, or a polarizer grid (known in antenna engineering) must be mounted over the slot 2. Both methods have disadvantages: rotation of the slot 2 in the wall of the waveguide 1 results in a phase reversal of the emitted wave in successive slots 2 of a resonance array with a half-wave spacing of the slots, and must therefore be reversed again, so that the effect of a rotation of the polarization direction cannot be utilized in such array arrangements. On the other hand, an additional arrangement of a polarizer grid requires high expenditures and is associated with additional damping losses.

In U.S. Pat. Nos. 6,028,562 A and 6,127,985 A, the rotation of the polarization direction is achieved by means of a cavity with an inlet and an outlet gap, the latter being used as the radiation source. The angle between the inlet and outlet gap of the cavity indicates the angle by which the polarization of the emitted wave is rotated. A disadvantage of this arrangement is that a continuous rotation of the polarization direction is not possible.

The present invention is based on a known slot antenna which has a feeding waveguide extending in the longitudinal direction for guiding an electromagnetic wave, and at least one slot constructed in a first wall of the feeding waveguide for the emission of a portion of the electromagnetic wave guided in the feeding waveguide, with devices provided for rotation of the polarization direction of the electromagnetic wave emitted by the slot.

One object to the invention is to provide a slot antenna which permits a continuous and steady rotation of the polarization direction of the electromagnetic wave emitted by the slot.

Another object of the invention is to provide such a slot antenna which can be produced in a simple and cost-effective manner.

These and other objects and advantages are achieved by the slot antenna according to the invention, which has a feeding waveguide extending in a longitudinal direction for guiding an electromagnetic wave and at least one slot constructed in a broad side of the feeding waveguide for emitting an electromagnetic wave. In addition, on the exterior side of the feeding waveguide, the slot is surrounded by an arrangement for rotating the polarization direction of the electromagnetic wave emitted by the slot. According to the invention, the slot is constructed in the longitudinal direction of the feeding waveguide, and the arrangement surrounding the slot is a rectangular polarizer waveguide. The opening at one end of the polarizer waveguide is connected with the broad side of the feeding waveguide; and the opening at its other end has an aperture which emits a wave that is excited through the slot in the polarizer waveguide. The emitted wave is aligned with respect to the slot such that a transverse axis of the polarizer waveguide forms an angle with the longitudinal axis of the slot. The latter angle represents the angle by which the polarization of the electromagnetic wave emitted from the slot into the polarizer waveguide is rotated.

It is a significant advantage of the slot antenna according to the invention that it can be produced in a simple manner, without additional damping losses.

According to a first preferred embodiment of the invention, the polarizer waveguide has a first dimension in the direction of one (first) transverse axis and has a second dimension in the direction of the other (second) transverse axis, the first dimension being larger and the second dimension being smaller than half the free-space wavelength $\lambda/2$ of the emitted electromagnetic radiation.

In this manner, only an $H_{10}$-wave (with a polarization in the direction of the second transverse axis) which is emitted from the aperture at the extreme end of the polarizer waveguide, with a polarization direction rotated by the angle $\alpha$, can be moved in the polarizer waveguide without any damping. The $H_{01}$-wave fraction in the direction of the first transverse axis is damped in the polarizer waveguide down to an insignificant amount.

According to a second embodiment of the invention, the polarizer waveguide has a first dimension in the direction of the first transverse axis and a second dimension in the direction of its second transverse axis, both the first and second dimensions being larger than half the free-space wavelength $\lambda/2$ of the emitted electromagnetic radiation. In this case, an arbitrary "elliptic" polarization of the emitted electromagnetic radiation can be achieved.

In this second embodiment, the first dimension and the second dimension of the polarizer waveguide may be made identical, and the angle $\alpha$ of the rotation of the polarization direction is $\alpha=45°$. In this case, both fundamental modes $H_{10}$ and $H_{01}$ of the polarizer waveguide are excited to the same extent.

According to the object of a further refinement of this second embodiment, when devices are also provided for the phase displacement in order to shift the orthogonally polarized waveguide modes of the polarizer waveguide with respect to one another (which particularly involves a displacement of the orthogonally polarized waveguide modes $H_{10}$ and $H_{01}$ by 90° with respect to one another), a purely circular polarization of the emitted electromagnetic radiation is obtained. The devices for the polarization-dependent or mode-dependent phase displacement are known in the state of the art.

Preferably, the length H of the polarizer waveguide is greater than one fourth the free-space wavelength $\lambda/4$ of the emitted electromagnetic radiation, which causes a sufficiently high damping of the cross-polarization ($H_{01}$-wave) relative to the useful polarization ($H_{10}$-wave). In addition, in this manner the bandwidth of the radiation output can be influenced to a desired degree and can be varied within wide limits. A significant increase of the length H of the polarizer waveguide with respect to one fourth the free-space length $\lambda/4$ represents an increase beyond the extent required for the suppression of the cross-polarization.

According to a further development of the slot antenna according to the invention, the slot or slots constructed in the broad side of the feeding waveguide extend in the longitudinal direction and in the center line of the feeding waveguide.

According to an alternative embodiment, it is provided that the slot or slots constructed in the broad side extend offset in the longitudinal direction and with respect to the center line of the feeding waveguide (offset slots).

Furthermore, according to an embodiment of the invention, the feeding waveguide may be constructed as a ridge waveguide.

According to a preferred embodiment of the invention, the slot antenna is constructed as an array antenna with many slot antenna elements of the same type having respective slots.

The slot antenna can advantageously be produced of a metallized plastic material.

DETAILED DESCRIPTION OF THE DRAWINGS

Figure 2:
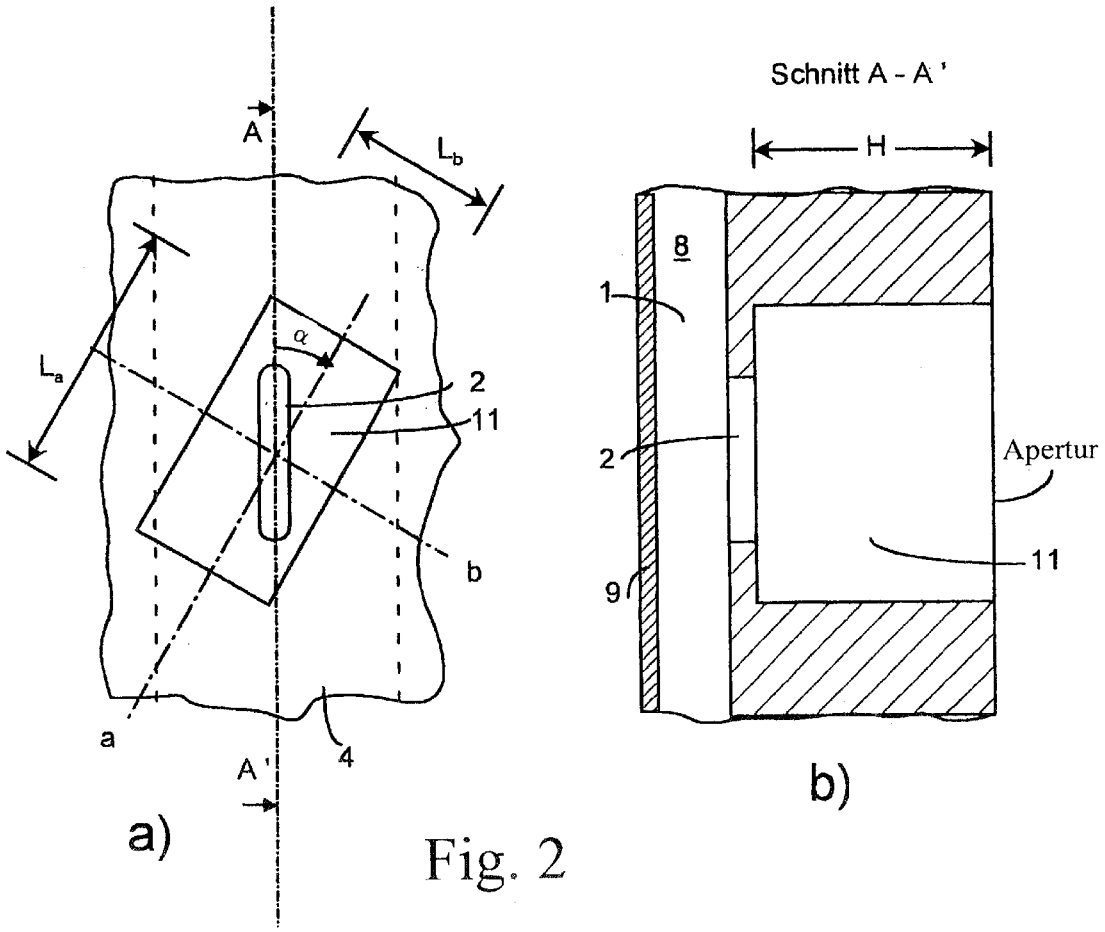

FIG. 1 is a simplified perspective representation of a slot antenna for explaining the polarization direction of the emitted electromagnetic waves;

FIG. 2*a* is a top view of a cutout of a slot antenna according to an embodiment of the invention; and FIG. 2*b* is a lateral sectional view along Line A—A' of the part of the embodiment illustrated in FIG. 2*a*.

DETAILED DESCRIPTION OF THE DRAWINGS

In the slot antenna illustrated in FIGS. 2*a*) and 2*b*), the reference number 1 indicates a rectangular feeding waveguide 1 extending in a longitudinal direction in which an electromagnetic wave is guided. The waveguide 1 has a broad side 4 in which at least one slot 2 extends in the longitudinal direction of the feeding waveguide 1 for emission of a portion of the electromagnetic wave guided in the feeding waveguide 1. The opposite side of the feeding waveguide 1 is formed by another broad side 9. FIG. 2*b* is a view of the narrow side 8 of the feeding waveguide 1.

A polarizer wave guide 11 is provided on the outside on the feeding waveguide 1 (thus, arranged behind it in the direction of the emission of the electromagnetic wave leaving the slot 2). This polarizer waveguide 11 may be, for example, a rectangular waveguide which has a first transverse axis a and a second transverse axis b perpendicularly to the first transverse axis a. The two transverse axes a and b are situated transversely to the emission direction of the electromagnetic radiation emerging from the slot 2. The first transverse axis a of the polarizer waveguide 11 is rotated by an angle $\alpha$ relative to the direction of the slot 2. The angle $\alpha$ corresponds to the desired rotation of the polarization direction with respect to the polarization direction of the slot 2.

In the embodiment illustrated in FIGS. 2*a* and 2*b*, the first dimension $L_a$ of the polarizer waveguide in the direction of the first transverse axis a is larger than half the free-space wavelength $\lambda/2$ of the electromagnetic radiation emitted from the slot 2. In contrast, the second dimension $L_b$ in the direction of the second transverse axis b of the polarizer waveguide 11 is smaller than half the free-space wavelength $\lambda/2$ of the emitted electromagnetic radiation. This configuration has the effect that only the $H_{10}$-wave, with a polarization in the direction of the second transverse axis b, can propagate to the outside through the polarizer waveguide 11 and be emitted without any damping, whereas the $H_{01}$-wave, orthogonal thereto, in the direction of the first transverse axis a, is damped.

The polarizer waveguide 11 has a length H which amounts to at least one quarter the free-space wavelength $\lambda/4$ of the emitted electromagnetic radiation. This causes damping of the undesirable cross-polarized wave fraction ($H_{01}$-wave), to a sufficiently small value. When the length H of the polarizer waveguide 11 is increased significantly beyond the above-mentioned quarter free-space wavelength $\lambda/4$, damping of the cross-polarized wave fraction $H_{01}$ is increased further and the bandwidth of the radiation output can be influenced within wide limits.

The slot antenna is particularly suitable as an array antenna with many slot antenna elements of the same kind which have respective slots 2.

The slot antenna is preferably produced of a metallized plastic material.

In alternative embodiments, it may be provided that the polarizer waveguide 11 in the direction of the first transverse axis a, has a first dimension $L_a$ which is larger than half the free-space wavelength $\lambda/2$ of the emitted electromagnetic radiation, and in which case also the second dimension $L_b$ in the direction of the second transverse axis b orthogonal thereto, is larger than half the free-space wavelength $\lambda/2$. The slot antenna is therefore suitable for the emission with an "elliptic" polarization. In the special case in which the first dimension $L_a$ and the second dimension $L_b$ of the polarizer waveguide 11 are identical—this is a special form of a rectangular waveguide—and in which the angle $\alpha$ of the rotation of the polarization direction amounts to $\alpha$=45°, a circular polarization of the emitted output can be achieved. For this purpose, additional devices for the phase displacement can be provided in order to displace the orthogonally polarized waveguide modes by 90° with respect to one another.

The slot or slots 2 constructed in the broad side 4 of the feeding waveguide 1 may, as in the embodiments illustrated in FIGS. 2*a* and 2*b*, be constructed to extend in the center line of the feeding waveguide 1.

Alternatively, the slots 2 may be constructed to extend offset with respect to the center line of the feeding waveguide 1 (offset slots).

The feeding waveguide 1 may also be constructed as a ridge waveguide.

By means of the invention, an antenna structure is created which can be produced in a simple and cost-effective manner and is capable of emitting polarized electromagnetic radiation, without the requirement of accepting additional damping losses.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A slot antenna comprising:

a feeding waveguide extending in a longitudinal direction for guiding electromagnetic waves;

at least one slot formed in a broad side of the feeding waveguide for emitting an electromagnetic wave; and an arrangement surrounding the slot on an exterior side of the feeding waveguide, for rotating a polarization direction of the electromagnetic wave emitted by the slot; wherein, the slot is formed in the longitudinal direction of the feeding waveguide;

the arrangement surrounding the slot is a rectangular polarizer waveguide having an opening at one end which is connected with the broad side of the feeding waveguide and an opening at its other end, which has an aperture via which the waveguide wave excited by the slot in the polarizer waveguide is emitted;

relative to the slot, the polarizer waveguide is aligned such that a first transverse axis of the polarizer waveguide forms an angle $\alpha$ with a longitudinal axis of the slot, the angle $\alpha$ representing an angle by which polarization of the electromagnetic wave emitted from the slot into the polarizer waveguide is rotated.

2. The slot antenna according to claim 1, wherein:

the polarizer waveguide has a first dimension in the direction of the first transverse axis and a second dimension in the direction of a second transverse axis; and the first dimension is larger and the second dimension is smaller than half of a free-space wavelength $\lambda/2$ of the electromagnetic wave emitted from the slot.

3. The slot antenna according to claim 1, wherein:

the polarizer waveguide has a first dimension in the direction of the first transverse axis and a second dimension in the direction of a second transverse axis; and the first and second dimensions are larger than half of a free-space wavelength $\lambda/2$ of the electromagnetic wave emitted from the slot.

4. The slot antenna according to claim 3, wherein:

the first and second dimensions are identical; and $\alpha=45°$.

5. The slot antenna according to claim 3, wherein phases of orthogonally polarized vibration modes excited in the polarizer waveguide are mutually displaced by 90°, whereby a purely circular polarization is generated.

6. The slot antenna according to claim 1, wherein length of the polarizer waveguide is greater than one fourth of a free-space wavelength $\lambda/4$ of the electromagnetic wave emitted from the slot.

7. The slot antenna according to claim 1, wherein the slot is formed in the center of the broad side of the feeding waveguide.

8. The slot antenna according to claim 1, wherein the slot is offset from the center of the broad side of the feeding waveguide.

9. The slot antenna according to claim 1, wherein the feeding waveguide comprises a ridge waveguide.

10. The slot antenna according to claim 1, wherein the slot antenna is constructed as an array element with a plurality slot antenna elements of the same kind having respective slots.

11. The slot antenna according to claim 1, wherein the slot antenna is produced of a metallized plastic material.

* * * * *